United States Patent [19]

Wöhr et al.

[11] 4,092,440

[45] May 30, 1978

[54] METHOD FOR ELECTROSTATIC COATING OF ARTICLES WITH POWDERED MATERIAL UNDER ELECTRIC FIELD STRENGTH LIMITATION

[75] Inventors: Rolf Wöhr, Leonberg; Gerhard Gulich, Stuttgart, both of Germany

[73] Assignee: Robert Bosch GmbH, Stuttgart, Germany

[21] Appl. No.: 626,109

[22] Filed: Oct. 28, 1975

[30] Foreign Application Priority Data

Oct. 31, 1974 Germany ..... 2451818

[51] Int. Cl.[2] ..... B05B 5/04

[52] U.S. Cl. ..... 427/33

[58] Field of Search ..... 427/33, 27

[56] References Cited

U.S. PATENT DOCUMENTS

| | | | |
|---|---|---|---|
| 2,568,611 | 9/1951 | Crouse | 427/33 |
| 3,083,121 | 3/1963 | Gauthier | 427/27 X |
| 3,641,971 | 2/1972 | Walberg | 427/27 X |

*Primary Examiner*—Bernard D. Pianalto

*Attorney, Agent, or Firm*—Flynn & Frishauf

[57] ABSTRACT

The high voltage between a rotary disk coating powder dispensing device and an electrically grounded article to be coated is maintained constant when the spacing between a spray disk at high potential and an article to be coated at ground potential is too great to permit a breakdown discharge, whereas at smaller spacings the current flowing as the result of transport of charged coating material is held constant, but when the spacing goes below a minimum value at which the energy stored in the disk device and in the wiring capacitance is sufficient to support a breakdown, the high-voltage supply is switched off, by short-circuiting the high-voltage transformer secondary winding. When the high-voltage supply is thus switched off, an acoustic or optical alarm is actuated to call attention to the necessity of restoring operation. The spacing between the article being coated and the disk device varies in operation of the coating process as a series of articles suspended on a conveyor are moved past the disk device by driving the conveyor.

5 Claims, 3 Drawing Figures

Figures 1, 2, 3:
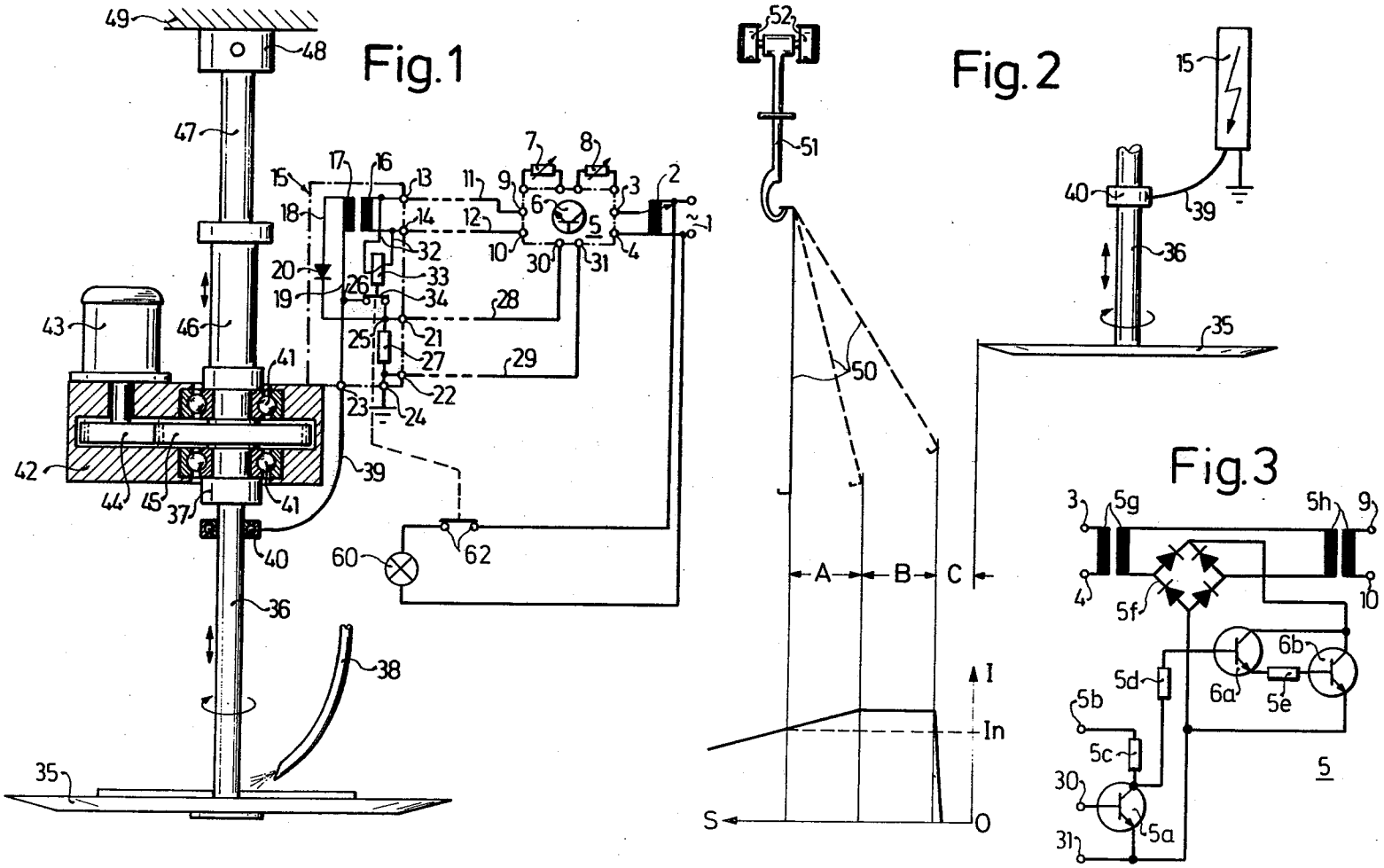

A
B
C
I
In
O
S

METHOD FOR ELECTROSTATIC COATING OF ARTICLES WITH POWDERED MATERIAL UNDER ELECTRIC FIELD STRENGTH LIMITATION

This invention relates to an apparatus and method for electrostatically providing protective coatings on articles and more particularly to an apparatus and method for so doing, in which the articles are conveyed in succession past a rotating spray disk which is supplied with coating powder and to which a high potential is applied, while the articles are maintained substantially at ground potential. The spray disk is typically caused to move up and down axially as the articles move by horizontally.

In methods and apparatus of this type, the spacing between the articles being coated and the spray disk varies as the result of relative motion of the articles and the spray disk, which may also include some vibration and swinging of the articles on their conveyor, resulting in variation in the electric field strength for a given voltage applied to the spray disk. The invention concerns a method and apparatus of this kind in which the electric field strength is limited in order to avoid electrical breakdown discharges.

Apparatus for electrostatically applying powder or liquid protective coatings are by now well known. One example thereof is described in published German Patent Application (OS) No. 20 23 29 8 . In such machines the coating is produced with a rotating spray disk or two or more spray disks arranged one above the other, and a liquid or powdery coating medium is accelerated outward by centrifugal force. By the application of a high voltage between the spray disk and the article being coated the coating material is electrically charged, thus in a sense ionized, and is attracted to the grounded article. When the article being coated approaches more closely, for example when it hangs obliquely relative to the spray disk, high-voltage breakdown discharges can take place, which could lead to explosions by reaction of the coating material being used.

Equipment is known for limiting the current in the case of a short circuit in which a resistance of high ohm value is inserted in the high-voltage lead to the spray disk. The insertion of a high resistance between the high-voltage supply and the spray disk of course does produce current limitation that limits the energy necessary for breakdown discharges between article and spray disk down to certain spacings. A certain amount of energy is necessary for the ionization of the particles to be desposited on the article, however, and that amount of energy can still lead to breakdown discharges between article and spray disk at small spacings.

It is an object of the present invention to overcome the disadvantages above mentioned in electrostatic spray coating subject to current limitation and to provide an apparatus and a method of operation for limiting the electrical field strength between the spray disk and the article to prevent undesired discharges.

SUMMARY OF THE INVENTION

Briefly, the electric field strength that varies in inverse relation to the spacing between article and spray disk is limited to prevent breakdown discharges by the provision of a current regulating system having an electronic limiting circuit that operates to limit the electric field strength that increases with approach of the article to the spray disk so that no voltage breakdown can take place.

An advantageous form of the invention provides that down to a first specified spacing between article and spray disk, at which spacing the current reaches an adjustable maximum, the applied high voltage will be maintained constant, whereas with further reduction of the spacing the current that flows as the result of the transport of charged coating material is held constant and, finally, when the spacing is reduced below an adjustable minimum spacing between article and spray disk, the applied high voltage is switched off. The advantage of this three-stage regulation is as follows: The approach of the article to the spray disk in the case of a steady applied high voltage produces a rise in current and at the same time an increase in the electric field strength that is responsible ultimately for breakdown discharges. In the spacing range A (FIG. 2) this field strength lies below the breakdown voltage and does not need to be limited. Upon further approach, corresponding to the spacing range B (FIG. 2), breakdown could take place, for which reason current limitation and thereby field strength limitation is provided. In the spacing range C (FIG. 2), the high voltage is switched off. In this last spacing range, the energy stored in the spray disk and the lead capacity are in themselves sufficient for breakdown discharges.

The invention further envisages that when the high voltage is switch off, the high-voltage winding of a transformer in the high-voltage supply will be short-circuited and grounded and that the resulting operation disturbance should be made known by some noticeable indication, for example an acoustic or an optical signal. This has the advantage that immediate measures for restoring the equipment to operation can be taken. It is also advantageous to provide the high-voltage supply and the short-circuiting device as a unit built into the spray disk mounting, so that it will partake of the axial movement of the spray disk if such movement is provided, with the result that only short and fixably positioned high-voltage cables are needed which are also of small capacitance.

The invention is described in further detail by way of illustrative example with reference to the drawings, in which:

FIG. 1 is a diagrammatic side view, partly in section, of the rotary spray disk, its mounting and drive, of an electrostatic apparatus, with a diagrammatic representation of the high-voltage supply for the voltage applied to the spray disk and of the electric field control system;

FIG. 2 shows a graph plotting the current flowing as the result of the applied high voltage against spacing between spray disk and article, which graph is drawn in juxtaposition to a diagrammatic representation of the spray disk and high-voltage supply, on the one hand, and the conveyor and article to be coated, on the other hand, of an electrostatic spray coating apparatus according to the invention; and FIG. 3 is a circuit diagram of one form of electric field strength limiting circuit usable in the arrangement of FIG. 1.

As shown in FIG. 1, an input voltage adjustment device 2 which may be a variable auto transformer, is connected to the commercial alternating current supply lines 1 and provides the alternating supply voltage at its output terminals 3 and 4 for a transistor control circuit 5. The transistor control circuit is diagrammatically symbolized by the transistor symbol 6 at the center of the block 5 designated in dash-dot lines and has, in addition to the power input connections 3 and 4, the power output connections 9 and 10, connections to a potentiometer 7 provided for the adjustment of the desired maximum value of current, connections to a potentiometer 8 provided for adjustment of the desired limit voltage ratio between the voltage at the input terminals 3 and 4 and at the output terminals 9 and 10 and feedback input connections 30 and 31 to be mentioned later. Low-voltage cable connections 11 and 12 connect the terminals 9 and 10 with the input terminals 13 and 14 of a high-voltage supply 15. The primary winding 16 of a high-voltage transformer is accordingly connected to the terminals 13 and 14. The secondary winding 17 of the high-voltage transformer has a connection 18 leading through a diode 20 to a terminal 21 and also has a connection 19 leading to the high-voltage terminal 23 of the high-voltage supply 15. A resistor 27 is connected between the terminal 21 and ground by means of a junction connection 25, ground potential appearing both at the terminal 24 and the terminal 22, terminal 24 being the terminal provided for grounding and the terminal 22, like the terminal 21, being provided for the feedback connections to the terminals 30 and 31 of the control circuit 5 respectively over the conductors 28 and 29. A relay 33 operating as a short-circuiting contactor has its coil connected across the terminals 13 and 14 by the connections 32. It short-circuiting contact 34 in its closed condition connects the junction 25 of the connection 18 to a junction 26 provided on the connection leading 19.

A spray disk 35 is mounted on a shaft 36 which itself is held in an insulating bushing 37. The supply of coating medium is provided through a supply conduit 38 that discharges the coating medium onto the upper surface of the disk 35. A high-voltage cable 39 connects the terminal 23 of the high-voltage supply 15 with a contact device 40 provided for the shaft 36, here in the form of a ball bearing contact. The insulation bushing 37 and with it the shaft 36 are mounted in two wall bearings 41 which are located in a drive casing 42. An electric motor 43 provides for the drive of the shaft 36 through a small gear 44 and a larger gear 45, the latter turning with the shaft 36. Above the drive housing 42 is a hydraulic displacement cylinder 46 provided with a piston 47. The upper portion of the piston 47 is mounted in a bearing 48 that is affixed to the cover or ceiling 49.

FIG. 2 shows in diagrammatic form the spray disk apparatus and the article to be coated and its holder. In other respects the same reference numerals are used as are shown in FIG. 1. An article 50 hangs on a chain conveyor 51 which in turn is movably supported in a guide track 52.

FIG. 2 also shows the principle of control for the electrostatic field of the coating apparatus. The article 50 hangs on the chain conveyor which is carried in the grounded guide track 52. The article 50 preferably and illustratively follows a circular path around the spray disk 35. The article can be subjected to oscillations as the result of its suspension on the chain conveyor and the movement of the latter, so that the spacing between the article and the spray disk is thereby varied.

The electrostatic coating process is performed by the application of a high-voltage between the spray disk 35 and the article that is grounded through the chain conveyor, the applied voltage building up an electric field between the spray disk and the article. The electric field strength becomes the greater, the smaller is the spacing between the spray disk and the article. The high voltage is produced as follows: A certain operating voltage is preselected by means of the reactive adjustment device 2 connected to the commercial power lines 1, this adjustment being made to provide a particular working voltage that varies in accordance with the coating material and the article shape. This voltage is stepped up in the high-voltage supply 15 by the transformer 16, 17 and the highvoltage, rectified by the diode 20, is applied to the spray disk through the connections 19 and 39, the rotary joint contact 40 and the shaft 36.

In order to prevent voltage breakdowns and consequent sparks, as the result of excessive electric field strength between spray disk and article, field strength control is provided in accordance with the spacing between article and spray disk in the spacing range B (FIG. 2), which is carried out in accordance with the invention by way of current regulation. This current regulation takes place by means of a transistor circuit 5.

As shown in FIG. 2, in the case of approach of the article towards the spray disk in the spacing range A, the high voltage is maintained constant, so that with the increase of electrical field strength the current likewise rises to a maximum value at the short end of the spacing range A.

In the case of further approach of the article to be coated to the spray disk through the spacing range B, the maximum current value set by the variable resistor 7 is imposed by the current-limiting circuit and thereby a field strength limitation is provided. This current control function is carried out by the transistor circuit 5 as follows. A voltage drop produced across the resistor 27 in the high-voltage circuit is picked off through the terminals 21 and 22. This voltage drop increases with the increase of the current in the high-voltage circuit and can be used for control of the current. This voltage drop is provided to the terminals 30 and 31 of the transistor circuit 5 over the respective connections 28 and 29 and is inversely connected to the base of the transistor 6 with increasing current in the high-voltage circuit and hence with increasing voltage drop at the resistor 27, the transistor base current is reduced as result of the inverting circuit (not shown in FIG. 2), and the supply voltage on the low-voltage side of the high-voltage transformer is thereby held down.

If an article 50 is located in the spacing range C of FIG. 2 with respect to the spray disk 35, then for safety reasons there is an immediate switching-off of the high voltage. This is produced by a comparison of the input voltage (terminals 3 and 4) and the output voltage (terminals 9 and 10) provide at the potentiometer or variable resistor 8 of the transistor circuit 5. In this case the high-voltage connection 19 is grounded by means of the short-circuiting relay 33 through its contact 34, because the current in the connection 32 has become too small to hold the short-circuiting contact 34 in the open condition. The operation interruption produced by switching off the high voltage is automatically signalled by an optical or acoustic indicator 60, for example through auxiliary contacts 61 and 62 of the relay 33.

Since the spray disk 35 is to be maintained at high voltage during operation, its shaft 36 is insulated from the drive housing 42 by the insulating bushing 37. The coating material supply is provided by the supply tube 38. The spray disk drive is provided by the electrical motor 43 through reduction gearing consisting of a small gear 44 and a large gear 45. Ball bearings 41 provide for rotatable mounting of the spray disk shaft. A hydraulic cylinder 46 with a piston 47 is provided above the drive casing 42 for up-and-down movement of the spray disk and its drive. The entire spray disk and drive assembly is mounted in a bearing 48 fixed in a ceiling or cover 49, to which guide rails or the like (not shown) for the non-rotating drive casing 42 may also be affixed.

The high-voltage supply equipment 15 is preferably built into the up-and-down moving spray disk structure, for example mounted on the casing 42 as diagrammatically indicated in FIG. 1, as the result of which only a short fixed high-voltage cable 39 that is low in capacity is needed. The flexible connections necessary for current supply are accordingly only the low-voltage cable conductors (11, 12, 28, 29).

FIG. 3 illustrates one form of transistor circuit that may be used in the arrangement of FIG. 1. The voltage drop appearing at the terminals 30 and 31, produced at the resistor 27 of FIG. 1, is supplied over an inverting transistor 5*a* that receives its supply voltage from the terminal 5*b* over a collector resistor 5*c*, and then is supplied, through the base resistor 5*d*, to the driver transistor 6*a* of a Darlington pair transistor circuit 6*a*, 6*b*. The driver transistor 6*a* controls the main transistor 6*b* of the Darlington circuit through the base series resistor 5*e*. A diode bridge circuit 5*f* having the controlled path of the main transistor 6*b* of the Darlington pair in one of its diagonals and having the other of its diagonals interposed in the current supply circuit of the high-voltage equipment 15 has the effect of reducing the value of the current in the current supply circuit of the high-voltage equipment 15 when the resistance of the controlled path of the transistor circuit 5 is raised in response to an increase in the input voltage furnished to the transistor circuit in the form of a voltage difference between the terminals 30 and 31. The provision of the isolating transformers 5*g* and 5*h* provides potential freedom for the transistor control circuit 5. The transistor control circuit 5 accordingly works as a variable resistance in the circuit linking the input terminals 3, 4 and the output terminals 9, 10.

Although the invention has been described with reference to a particular illustrative embodiment, it will be understood that variations are possible within the inventive concept.

We claim:

1. A method of electrostatically coating articles supported by a moving conveyor with electrically charged powder dispensed from a rotary disk device, which method comprises the steps of:

applying an electric potential between said disk device and said articles;

moving a series of articles in succession past said rotary disk device at a spacing distance from said device by driving said conveyor, the distance between the disk and the article being subject to variation as the articles are thus moved past the disk;

regulating said applied electric potential so that for a spacing between the disk device and an article being coated greater than a first predetermined spacing distance at which the current flow produced by the transport of charged powder is less than a predetermined value, the voltage between said disk device and said articles remains constant and the current flow produced by the transport of charged powder therefore increases with decreased spacing, and so that for any spacing between said disk device and an article being coated which is less than said first predetermined distance and not less than a second predetermined spacing distance said current flow is maintained at substantially the same value and said applied potential therefore decreases with decreasing spacing, said second predetermined spacing distance being determined substantially as that for which said applied potential is reduced to a predetermined value, and switching off said potential when the spacing between said disk device and said article being coated becomes less than said second predetermined spacing distance as determined by reduction of said applied potential to substantially said predetermined value thereof.

2. Method as defined in claim 1, in which said articles are maintained at substantially ground potential during all the steps of the method and in which, when said potential is switched off as the result of the spacing between the disk and an article being coated having become less than said second predetermined spacing distance in accordance with the method steps mentioned last in claim 1, the additional steps are performed of substantially grounding the disk device and of short-circuiting and substantially grounding a high voltage transformer winding used for providing said potential.

3. Method as defined in claim 1, in which the additional step is performed of producing a noticeable signal when said potential is switched off as the result of the spacing between said disk device and an article being coated having become less than said second predetermined spacing distance.

4. A method of electrostatically coating articles as defined in claim 1, in which said regulating step is performed by automatically controlling an amount of resistance interposed between a source of alternating current power and the primary winding of a high-voltage transformer that is part of the equipment for applying said electric potential between said disk device and said articles, the automatic controlling operation being responsive to a voltage proportional to current flow produced by the transport of charged powder and having a threshold at said predetermined value of said current flow below which the interposed resistance is constant and said applied electric potential is consequently maintained substantially constant, and in which method, further, the switching-off step is performed by means of a voltage-sensitive switch arranged to short-circuit the high-voltage winding of said high-voltage transformer through at least one rectifying element of said equipment for applying an electric potential between said disk device and said articles when said applied voltage falls substantially below said predetermined value thereof.

5. A method as defined in claim 4, in which the step of switching off said applied potential is performed by said voltage-sensitive switch in response to the value of voltage across the primary of said high-voltage transformer and in which the contacts of said voltage-sensitive switch are so connected that upon performance of said switching-off step, the potential of said disk device is grounded through a circuit element that develops said voltage proportional to said current flow to which said automatically controlling operation is responsive.

* * * * *